US005789077A

United States Patent [19]

Nakahama et al.

[11] Patent Number: 5,789,077

[45] Date of Patent: Aug. 4, 1998

[54] METHOD OF FORMING CARBIDE-BASE COMPOSITE COATINGS, THE COMPOSITE COATINGS FORMED BY THAT METHOD, AND MEMBERS HAVING THERMALLY SPRAYED CHROMIUM CARBIDE COATINGS

[75] Inventors: Syuhei Nakahama; Hisamichi Nagahara, both of Chiba-ken; Masamichi Kawasaki, Tokyo; Yoshio Harada; Junichi Takeuchi, both of Hyogo-ken, all of Japan

[73] Assignees: Ebara Corporation, Tokyo, Japan; Tocalo Co., Ltd., Kobe, Japan

[21] Appl. No.: 494,695

[22] Filed: Jun. 26, 1995

[30] Foreign Application Priority Data

Jun. 27, 1994 [JP] Japan ..... 6-144535
Jun. 27, 1994 [JP] Japan ..... 6-144536

[51] Int. Cl.[6] ..... C23C 4/10

[52] U.S. Cl. ..... 428/336; 427/214; 427/215; 427/216; 427/213.31; 427/228; 427/446; 427/454; 427/376.6; 427/419.7; 427/255.2; 427/249; 427/450; 428/469; 428/457; 428/697; 428/698; 428/699

[58] Field of Search ..... 428/698, 336, 428/697, 469, 457, 699; 427/214, 215, 216, 228, 213.31, 446, 450, 454, 376.6, 419.7, 255.2, 249

[56] References Cited

U.S. PATENT DOCUMENTS 2,685,543 8/1954 Sinderband .
3,885,064 5/1975 Komatsu et al. .
3,959,092 5/1976 Komatsu et al. .
4,230,751 10/1980 Komatsu et al. .
4,239,556 12/1980 Cline et al. .
4,250,208 2/1981 Arai .

FOREIGN PATENT DOCUMENTS 2 370106 6/1978 France .
55-104471 8/1980 Japan .
55-164068 12/1980 Japan .
56-51567 5/1981 Japan .

OTHER PUBLICATIONS

M.M.I. Technical Bulletin, vol. 22, No. 3, pp. 361–369, 1985, "Practical Application of Superalloys and Duplex Protective Coatings In Land Base Gas Turbines", (with partial English translation).

Journal of Corrosion Resistance Technology, vol. 31, pp. 281–292, 1982, Yoshio Harada, "Protective Coatings Against High Temperature Corrosion", (with partial English translation).

Thin Solid Films, vol. 107, No. 4, pp. 427–435, Sep. 1983, T.A. Taylor, "Development of Several New Nickel Aluminide and Chromium Carbide Coatings For Use In High Temperature Nuclear Reactors".

Chemical Abstracts, vol. 100, No. 4, Jan. 23, 1984, AN–24865y, L. Repina, et al., "Hardening of Steel Before Chromizing".

Patent Abstracts of Japan, vol. 4, No. 159 (C–030), Nov. 6, 1980, JP–A–55–104471, Aug. 9, 1980.

Patent Abstracts of Japan, vol. 10, No. 78 (C–335), Mar. 27, 1986, JP–A–60–215754, Oct. 29, 1985.

*Primary Examiner*—Archene Turner
*Attorney, Agent, or Firm*—Oblon, Spivak, McClelland, Maier & Neustadt, P.C.

[57] ABSTRACT

Thermally sprayed coatings made from carbides of metals having greater carbon affinity than Cr in the presence of free carbon, or thermally sprayed coatings made from carbides of metals having smaller carbon affinity than Cr are heat treated in a chromium halide containing atmosphere which also contains hydrogen gas, whereby activated metallic Cr is precipitated in a fine particulate form, which is allowed to act on the thermally sprayed coatings, whereupon a $Cr_{23}C_6$-form carbide is created not only on the coating surface but also in its interior, particularly within pores, to form a modified layer, thereby compositing the thermally sprayed coatings.

10 Claims, 3 Drawing Sheets

METHOD OF FORMING CARBIDE-BASE COMPOSITE COATINGS, THE COMPOSITE COATINGS FORMED BY THAT METHOD, AND MEMBERS HAVING THERMALLY SPRAYED CHROMIUM CARBIDE COATINGS

BACKGROUND OF THE INVENTION

The present invention relates to a method of forming carbide-base composite coatings. More particularly, the invention relates to a method by which a $Cr_{23}C_6$-form chromium carbide is both coated on a surface of a thermally sprayed carbide or carbide-based cermet coating and diffused into its interior so as to form a $Cr_{23}C_6$-form carbide impregnated modified layer.

The present invention also relates to members having a thermally sprayed chromium carbide coating. More particularly, the invention relates to members comprising a substrate having a thermally sprayed chromium carbide or chromium carbide-based cermet coating formed on its surface, in which the surface of the thermally sprayed coating in turn has $Cr_{23}C_6$-form chromium carbide either coated on the surface or diffuse into the interior to make a composite structure having a modified layer that is impregnated with the $Cr_{23}C_6$-form carbide.

The composite coating according to the first aspect of the invention is produced by modifying thermally sprayed, carbide-base coatings formed on the surfaces of various substrates vulnerable to chemical and mechanical damage, such as boilers, steam turbines, gas turbines, blowers, pumps, coke or mineral ore comminuting machines and conveyors, as well as sintered substrates that contain carbides as the chief component.

The composite members according to the second aspect of the invention are used in those applications where chemical and mechanical damage are common phenomena, as in boilers, steam turbines, gas turbines, blowers, pumps, coke or mineral ore comminuting machines and conveyors.

Thermally spray coatings are generally formed by first melting or softening the powders of such materials as metals, ceramics or cermets with a plasma or with an ignited inflammable gases and then blowing the particles of those materials against the surface of substrates (work-pieces). Thermally spray coatings thus formed have the following features.

(1) If metal or alloy particles are thermally sprayed in air atmosphere, their surfaces will be covered with oxide coatings and individual particles are joined together with the intervening oxide coating present. Hence, the force of bond between the particles is weak and, what is more, with pores being present between thermally sprayed particles, the resulting coating is low in density and lacks adhesion to the workpiece.

(2) Unlike metals, ceramic thermal spray materials such as oxides, borides, carbides and nitrides are difficult to melt completely within heat sources for thermal spray and, in addition, their brittle nature causes the particles to join only insufficiently. Hence, the particles are prone to destruction upon colliding with the workpiece. Another problem with carbide and nitride coatings is that they oxidize, decompose or otherwise deteriorate in hot heat sources for thermal spray and, hence, they contain more pores and are less adhering than metal coatings.

(3) With a view to compensating for these drawbacks, cermets comprising carbides supplemented by the addition of metals such as Co, Ni and Cr have conventionally been thermally sprayed to provide coatings of better performance due to the function of the metals as binders. Most carbides are currently commercialized in the form of thermally sprayed coatings from cermets. However, even coatings made of cermets as thermal spray materials have not yet succeeded in preventing the aforementioned problems of pore formation and reduced adhesion.

Another method that has been proposed to compensate for the defects of the prior art, particularly as regards the thermally sprayed cermet coatings, is heating a thermally sprayed coating to a temperature close to its melting point so that it is brought to a fully or partly molten state while, at the same time, it is bound to the workpiece metallurgically, as in the case of a thermally sprayed, self-fluxing alloy specified in JIS H0803. However, this method involving a problem in that applicable alloy components are limited and that it does not work effectively with thermally sprayed carbide coatings.

Other methods that have so far been proposed include: thermally spraying an Ni-Cr alloy onto a surface of a substrate and applying chemical vapor-phase plating to coat the surface of the thermally sprayed coating with Al or Cr or fill the pores in said surface with Al or Cr (see Japanese Patent Public Disclosure (Laid-Open) No. 10447/80); chromizing or aluminizing a thermally sprayed coating of an alloy having at least one rare earth element added to a metallic material containing at least one of Cr, Ni, Al and Co (see Japanese Patent Public Disclosure (Laid-Open) No. 51567/81); and thermally spraying a heat-resistant Ni-Cr alloy material, applying a slurry having an Al-Si or Al powder suspended in an organic solvent and subsequently heat-treating the applied slurry to have the Al-Si or Al particles diffuse into the pore-containing area of the thermally sprayed coating (see Japanese Patent Public Disclosure (Laid-Open) No. 54282/82).

As described above, the methods that have heretofore been reviewed for modifying thermally sprayed metal coatings are by melting with heat or by diffusing other metal components into the thermally sprayed coating. These methods are effective for the purpose of modifying thermally sprayed metal coatings but are often inapplicable to thermally sprayed, carbide-base coatings. In an effort to modify thermally sprayed, carbide-base coatings, emphasis has been placed exclusively on such objectives as reducing the incidence of pores and assuring better adhesion by improving the thermal spray techniques and conditions therefor.

However, the efforts toward improvements in these aspects have been insufficient for complete assurance against the formation of pores in thermally sprayed coatings.

To deal with this problem and with a view to eliminating the residual pores, a method is currently practiced that comprises coating the surfaces of thermally sprayed, carbide-base coatings with paints, sealants, etc. that have organic polymers dissolved in solvents. However, this approach does not provide a complete solution to the problem since it is not directed to an improvement of the thermally sprayed, carbide-base coatings per se.

SUMMARY OF THE INVENTION

The principal object of the invention according to its first aspect is to eliminate the defects of thermally sprayed, carbide-base coatings of a single-layered structure.

Another object of the invention is to eliminate the pores in a thermally sprayed, carbide or carbide-based cermet coating (both types of coatings are hereunder referred to simply as "thermally sprayed, carbide-base coatings") while modifying their surface with a hard chromium compound and improving the adhesion to the substrate of the thermally sprayed coating.

A further object of the invention is to have a $Cr_{23}C_6$-form chromium carbide cover the surface of thermally sprayed, carbide-base coatings and diffuse into their interior so as to improve the microhardness and density of the coatings.

Yet another object of the invention is to improve the ability of thermally sprayed, carbide-base coatings to withstand corrosion, wear and erosion.

The present invention according to its first aspect has been developed as effective means for attaining the above-described objects and it provides a method in which a thermally sprayed, carbide-base coating containing free carbon or a carbide of a metal having smaller carbon affinity than Cr is heat treated in a chromium halide containing atmosphere which also contains hydrogen, whereby the fine particles of activated metallic Cr that are produced by the hydrogenation reaction during the heat treatment are deposited on and diffused into the surface of the thermally sprayed coating while, at the same time, the activated metallic chromium reacts with the components of the coating (e.g., free carbon to produce a $Cr_{23}C_6$-form carbide, whereupon a composite coating is formed.

The principal object of the invention according to its second aspect is to eliminate the defects of conventional thermally sprayed, carbide-base coatings formed on the surface of members.

Another object of the invention is to eliminate the pores in a thermally sprayed, chromium carbide or chromium carbide-based cermet coating that are formed on the surface of a member (both types of coatings are hereunder referred to simply as "thermally sprayed, chromium carbide coatings") while modifying their surface with hard, activated chromium compounds and improving the adhesion of the thermally sprayed coating to the substrate.

A further object of the invention is to have $Cr_{23}C_6$-form chromium carbide cover the surface of thermally sprayed, chromium carbide ($Cr_3C_2$ and $Cr_7C_3$) base coatings and diffuse into their interior so as to improve the microhardness and density of the coatings.

Yet another object of the invention is to improve the ability of thermally sprayed, chromium carbide coatings formed on the surfaces of members to withstand corrosion, wear and erosion.

DETAILED DESCRIPTION OF THE INVENTION

Figure 1A:
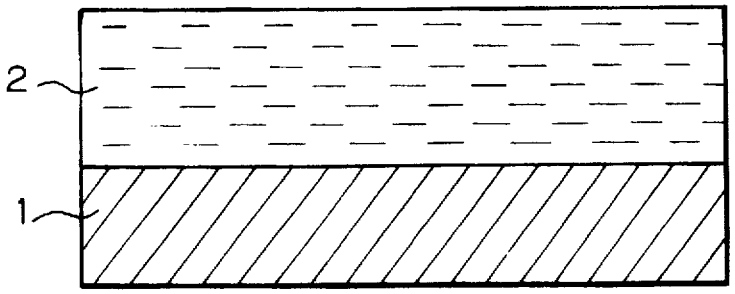
FIG. 1A is a cross section of a thermally sprayed coating before it is treated for modification.

The present invention according to its second aspect has been developed as effective means for attaining the above-described objects. According to this invention, a thermally sprayed, chromium carbide coating based on $Cr_3C_2$, $Cr_7C_3$ chromium carbide that optionally contains free carbon or a carbide of a metal having smaller carbon affinity than Cr is heat treated in a chromium halide containing atmosphere which also contains hydrogen, whereby the fine particles of chemically active, fine-particulate metallic Cr that are produced by the hydrogenation reaction during the heat treatment are deposited on the surface of said thermally sprayed coating while, at the same time, they are diffused into the interior, mainly through pores, with the activated metallic chromium also reacting with the components of the coating (e.g., free carbon) to produce a $Cr_{23}C_6$-form carbide, whereby the coating is modified.

Thus, according to the method of the first aspect of the invention, the fine particles of chemically active metallic Cr that are precipitated on the surface of the thermally sprayed, carbide-coating not only cover said coating but also get into the pores in it and react with the free carbon in said thermally sprayed, carbide base coating (also including the free carbon supplied from the carbide of a metal having smaller carbon affinity than Cr) to create a $Cr_{23}C_6$-form carbide that contributes to improvements, chiefly in the microhardness and density of the coating. Having been developed on the basis of this concept, the first aspect of the present invention provides, in essence, the following:

(1) A method of forming a carbide-base composite coating which comprises the steps of forming a thermally sprayed, carbide-base coating on a surface of a substrate, then heat treating said thermally sprayed coating in a chromium halide containing atmosphere which also contains hydrogen gas, thereby forming a composite coating comprising both a thermally sprayed, carbide-base coating and a modified layer that has a $Cr_{23}C_6$-form carbide coated on a surface of said thermally sprayed, carbide-base coating and diffused into its interior.

(2) A method of forming a composite carbide-base coating which comprises the steps of forming a thermally sprayed, carbide-base coating on a surface of a substrate, then heat treating said thermally sprayed coating in a chromium halide containing atmosphere which also contains hydrogen gas, thereby precipitating the fine particles of chemically active metallic chromium on said thermally sprayed coating while, at the same time, allowing said fine particles of metallic chromium to be coated on a surface of said thermally sprayed coating and diffused into its interior so as to produce a $Cr_{23}C_6$-form chromium carbide through reaction with the components of said coating, thereby forming a composite coating having the thermally sprayed, carbide-base coating modified both on the surface and in the interior.

(3) Said thermally sprayed, carbide-base coating contains either 0.01–5 wt % of free carbon or 0.1–100 wt % of a carbide of a metal having smaller carbon affinity than chromium or both.

(4) The carbide in the thermally sprayed, carbide-base coating is at least one member selected from among NbC, TaC, HfC, VC, ZrC, MnC, FeC, NiC, CoC, SiC, WC, MoC, TiC and BC and mixtures thereof.

(5) Said thermally sprayed, carbide-base coating is formed by thermally spraying a carbide or a carbide-based cermet having the carbide mixed with at least one metal selected from among Ni, Cr and Co.

(6) The thermally sprayed carbide or carbide-based cermet coating is formed by thermal spray using electric energy or the detonation or burning flame of an inflammable gas as a heat source.

(7) The heat treatment in a chromium halide containing atmosphere which also contains hydrogen gas is performed using at least one chromium halide selected from among chromium chloride, chromium bromide, chromium fluoride and chromium iodide, with the atmosphere being heated at 500°–1,200° C. for performing reduction reaction with the hydrogen gas contained, thereby precipitating fine particulate metallic chromium.

By applying one of these methods described above, one can form the following thermally sprayed, composite carbide-base coating.

(8) A composite coating comprising a thermally sprayed coating that is formed on a surface of a substrate and which is made of at least one carbide selected from among NbC, TaC, HfC, VC, ZrC, MnC, FeC, NiC, CoC, SiC, WC, MoC, TiC and BC or a carbide-based cermet made of said carbide and at least one metal selected from among Ni, Cr and Co, and a modified layer having a $Cr_{23}C_6$-form carbide produced both on the surface of said thermally sprayed coating and in its interior through the reaction of metallic chromium precipitated in a fine particulate form in a heated atmosphere consisting of hydrogen and a chromium halide with the carbon and chromium components in said thermally sprayed coating.

According to the second aspect of the invention, the fine particles of chemically active metallic Cr that are precipitated on the surface of said thermally sprayed chromium carbide coating not only cover the coating but also get into the pores in it and react with said thermally sprayed, carbide-base coating or the free carbon in it (also including the free carbon as supplied from the carbide of a metal having smaller carbon affinity than Cr) to create a $Cr_{23}C_6$-form carbide that contributes to improvements, chiefly in the microhardness and density of the coating. Having been developed on the basis of this concept, the second aspect of the present invention provides, in essence, the following:

(1) A member having a thermally sprayed chromium carbide coating comprising a substrate having a thermally sprayed chromium carbide coating formed on its surface, said thermally sprayed chromium carbide coating being such that at least the surface layer thereof modified by deposition and impregnation of $Cr_{23}C_6$-form chromium carbide.

(2) The carbide that makes up said thermally sprayed carbide coating formed on the surface of the substrate contains $Cr_3C_2$ either alone or in admixture with $Cr_7C_3$.

(3) Said thermally sprayed carbide coating contains $Cr_3C_2$, $Cr_7C_3$ carbide that does not contain free carbon or contains either 0.01–5 wt % of free carbon or 0.1–100 wt % of a carbide of a metal having smaller carbon affinity than chromium or both.

(4) Said thermally sprayed carbide coating is formed by thermally spraying a carbide or a carbide-based cermet having the carbide mixed with at least one metal selected from among Ni, Cr and Co.

(5) The thermally sprayed carbide or carbide-based cermet coating is formed by thermal spray using electric energy or the detonation or burning flame of an inflammable gas as a heat source.

(6) The heat treatment in a chromium halide containing atmosphere which also contains hydrogen gas is performed, with the thermally sprayed chromium carbide coating being either placed in the gas of at least one chromium halide selected from among chromium chloride, chromium bromide, chromium fluoride and chromium iodide or buried in a powder evolving such gas and with the atmosphere being heated at 500°–1,200° C. for performing reduction reaction with the hydrogen gas contained, thereby precipitating chemically active, fine particulate metallic chromium.

To summarize the characteristic features of the first aspect of the present invention, a $Cr_{23}C_6$-form carbide is produced on the surface of a thermally sprayed, carbide-base coating and in its interior, particularly in the pores in it, through the reaction between activated metallic Cr and the components such as free carbon in the coating, so that the carbide not only covers the surface of the coating but also diffuses into its interior, whereby the coating is composited and, hence, modified.

To summarize the characteristic features of the second aspect of the present invention, the activated metallic chromium reacts with the components such as free carbon in the thermally sprayed, carbide-base coating to produce $Cr_{23}C_6$-form carbide on the surface of the coating and in its interior, particularly in the pores in it, and the carbide is allowed not only to cover the surface of said coating but also to diffuse into its interior, whereby the thermally sprayed coating is composited and, hence modified.

Chromium carbides commonly used as thermally spraying materials are either a $Cr_3C_2$-form carbide (rhombic) or a mixture thereof with a $Cr_7C_3$-form carbide (trigonal or rhombic). These materials differ greatly in characteristics from the $Cr_{23}C_6$-form chromium carbide (cubic) which is used in the present invention for modification purposes.

Stated more specifically, the conventional crystal forms of chromium carbide, $Cr_3C_2$ and $Cr_7C_3$, have Cr contents of 86.8% and 91.0%, respectively. In contrast, the $Cr_{23}C_6$-form chromium carbide has a higher Cr content (94.3%) with correspondingly high density and hardness. It should particularly be mentioned that when the metallic chromium that is precipitated as a result of reaction between hydrogen gas and chromium halide contacts free carbon, $Cr_3C_2$ and $Cr_7C_3$ will form temporarily but they eventually turn to the stoichiometrically stable $Cr_{23}C_6$ in the employed atmosphere for heat treatment (500°–1,200° C.).

Thus, the present invention in its first aspect is characterized by a new compositing technique that modifies thermally sprayed, carbide-base coatings with said $Cr_{23}C_6$-form chromium carbide. Details are given below.

The carbide-base thermally spraying material to be used in the invention is the powder (30–60 μm) of at least one carbide selected from among NbC, TaC, HfC, VC, ZrC, MnC, FeC, NiC, CoC, SiC, WC, MoC, TiC and BC. These carbides may be used either singly or in admixtures.

Alternatively, the thermally spraying material for use in the invention may be a carbide-based cermet that is prepared by adding metallic elements such as Co, Ni and Cr to the above-mentioned carbides. The metallic elements may be added either singly or in such a way as allows the use of two or more of such metals. The reason for using such carbide-based cermets is that thermally sprayed coatings are difficult to form from the carbides alone and that, even if coatings are formed, they have not only weak adhesion but also a porous structure and, hence, are incapable of serving the intended function of thermally sprayed, carbide-base coatings. On the other hand, when metallic elements are added to chromium carbides, the metal components will melt completely within a heat source for thermal spray and work as a binder to form denser and more adhering coatings.

However, even if coatings are formed by thermally spraying such cermets, the coatings still contain about 0.5–5.0% of pores, which are detrimental to the purpose of improving the adhesion and wear resistance to the coatings. It is in this respect that the idea of the present invention to modify the coatings by compositing them will prove effective.

It is essential for the purposes of the present invention to have at least free carbon contained in the above-described carbide-base thermally spraying materials. Such free carbon can generally be formed by adding excess carbon when heating metal and carbon or carbon compounds (e.g., CO and CmHn) in the production of various metal carbides.

One of the characterizing features of the invention is to use the free carbon defined above. Stated more specifically, if this free carbon and the metal component are allowed to contact and react in a fine particulate form on the hot thermally sprayed coating, the metal component will immediately turn to a carbide and join firmly to the components of the thermally sprayed coating; in addition, the thermally sprayed coating is covered by the $Cr_{23}C_6$-form carbide, or the new crystal form of carbide that has been generated by that reaction and, this carbide also gets into the interior of the coating, particularly, in the pores in it, thereby binding with the constituent carbide particles in the coating and acting in such a way as to modify its properties in a markedly favorable manner.

This process of modifying thermally sprayed coatings will now be described. The process of modification consists basically of the following two steps (1) and (2).

(1) First, the surface of a workpiece (substrate) is treated with a plasma or the burning flame of an inflammable gas to form a thermally sprayed, chromium carbide-base coating.

(2) Then, the thus thermally sprayed coating is subjected to a heat treatment for its modification in a hot (500°–1,200° C.) atmosphere containing hydrogen and a chromium halide.

The mixing molar ratio of the chromium halide gas and hydrogen gas in the reaction vessel is preferably adjusted to lie within a range from about 4:1 to about 1:4.

As a result of the heat treatment (2), hydrogen reacts with the vapor of a chromium halide to generate fine particulate (0.1 μm), activated metallic Cr:

$$CrX_2+H_2 \rightarrow Cr+2HX \quad (1)$$

Where X is an elemental halogen (e.g., Cl, F, Br or I).

The fine particles of activated metallic Cr that are generated in accordance with Eq. (1) are precipitated on the thermally sprayed coating. As a result, the precipitated metallic Cr not only covers the thermally sprayed coating but also gets into the coating, primarily through the pores that have been formed in it, thereby filling them up. If the pores penetrate the coating, the precipitated metallic Cr will also reach the surface of the workpiece (substrate) and binds metallurgically with the metal substrate to form an alloy that has an enhanced adhesion.

The metallic Cr that has been generated during the reaction further reacts with the free carbon in the thermally sprayed, chromium carbide-base coating in the hot atmosphere to produce $Cr_{23}C_6$ which is thermodynamically the most stable crystal form of chromium carbide.

As a result, the thermally sprayed, chromium carbide-base coating is covered with this $Cr_{23}C_6$-form carbide and, at the same time, the carbide diffuses into the surface layer of the coating to form a modified layer. The carbide also gets into the pores in the coating to fill them up, thereby eliminating them. Hence, the adhesion between the workpiece (substrate) and the thermally sprayed coating is improved and, what is more, the creation of the $Cr_{23}C_6$-form carbide increases the hardness of the thermally sprayed, chromium carbide base coating which is hence modified to a composite state that is markedly improved in its properties. The diffusion layer that has turned to $Cr_{23}C_6$ preferably has a thickness of about 1–30 μm. If the diffusion layer is thinner than about 1 μm, the intended effect of the diffusion treatment may not be sufficiently attained. If the diffusion layer is thicker than about 30 μm, not only is prolonged treatment required but also the mechanical strength of the basis metal part that has been provided with a thermally sprayed coat deteriorates.

The above-described modification treatment may be performed by any other methods that effectively provide the desired atmosphere, such as by heat treatment, with the thermally sprayed coating being buried in a mixture of a chromium powder and ammonium chloride.

When modification treatment is conducted using such a penetrant, the following chemical reactions will occur in the penetrant. First, the ammonium chloride in the penetrant decomposes to evolve hydrogen chloride gas:

$$NH_4Cl \rightarrow CrCl_2+HCl \quad (2)$$

Then, HCl reacts with the Cr powder in the penetrant to generate $CrCl_2$:

$$2HCl+Cr \rightarrow CrCl_2+H_2 \quad (3)$$

$CrCl_2$ is reduced with $H_2$ gas separately supplied from the outside of vessel for treatment, whereupon the fine particles of metallic chromium are precipitated in the atmosphere:

$$CrCl_2+H_2 \rightarrow Cr+2HCl \quad (4)$$

Cr precipitation also occurs if the reaction proceeds in a direction reverse to that designated by Eq. (3). However, as the volume of $H_2$ being supplied externally increases, the reaction expressed by Eq. (4) will predominate and the atmosphere is held in a reducing state; hence, Cr that is precipitated by the reaction of Eq. (4) will become highly active.

Therefore, if the fine particles of Cr precipitated by the reaction of Eq. (4) deposit on the surface of the free carbon containing, thermally sprayed, chromium carbide coating, they will immediately react with the free carbon in accordance with Eq. (5), thereby creating $Cr_{23}C_6$:

$$23Cr+6C \rightarrow Cr_{23}C_6 \quad (5)$$

The invention also envisages the case where free carbon is not contained in the thermally sprayed carbide coating. The free carbon may be replaced by, or used in combination with, "a carbide of a metal having smaller carbon affinity than Cr" (i.e., a carbide that will supply free carbon upon reaction) in the thermally sprayed coating so that the thermally sprayed carbide coating can be modified by compositing. Useful carbides of metals having smaller carbon affinity than Cr include MnC, FeC, NiC, CoC, SiC, WC, CeC, SmC, CaC, SrC, MoC, MgC and BC. If such carbides are contained in the thermally sprayed coating, they will react with the fine particles of metallic Cr which have been generated by the reaction of Eq. (1) and the reaction proceeds in accordance with the scheme represented by the following Eq. (6), whereby the $Cr_{23}C_6$-form chromium carbide is created in the same manner as already described above:

$$6MC+23Cr \rightarrow Cr_{23}C_6+6M \quad (6)$$

where MC is a carbide of a metal having smaller carbon affinity than Cr.

Carbides of metals having greater carbon affinity than Cr (i.e., V, Be, U, Nb, Ta, Ti, Hf and Zr) will not react directly with the fine particles of Cr. Therefore, if carbides of these metals having great carbon affinity are used as thermally spraying materials, they must be supplemented by the addition of free carbon or used in combination with the carbides of metals having smaller carbon affinity than Cr.

In the present invention, it is practical to perform the heat treatment (2) with the temperature for reaction with hydrogen being set in the range from 500° to 1,200° C., preferably in the range from 600° to 1,000° C. Below 500° C., the reaction of Eq. (1) is unduly slow; above 1,200° C., the metallic material which serves as the substrate of the thermally sprayed coating will experience considerable mechanical deterioration.

The purposes of the invention can be attained if the content of free carbon in the thermally sprayed carbide coating lies within the range from 0.01 to 5 wt %. With less than 0.01 wt % free carbon, $Cr_{23}C_6$ will not be created in adequate amounts. With more than 5 wt % free carbon, not only is difficulty involved in application procedures for forming a thermally sprayed carbide coating but also the formed coating will have only poor quality.

As regards the content of the carbide of a metal having smaller carbon affinity than Cr, the present invention is applicable over the range from 0.1 to 100 wt %. If its content is within this range, the carbide of interest can be applied irrespective of whether the free carbon defined above is present or not.

To thermally spray the surface of a substrate with the carbide or carbide-based cermet described hereinabove, any heat source such as a plasma or the burning flame of an inflammable gas may be used; if desired, detonation thermally spray, physical vapor deposition, chemical vapor deposition or any other suitable techniques may be employed.

The thermally sprayed coating to cover the surface of a substrate has preferably a thickness of 10–2,000 μm, with the range from 30 to 500 μm being particularly preferred. If the thermally sprayed coating is thinner than 10 μm, the desired modification effect will not be attained; if the coating is thicker than 2,000 μm, the production cost will increase to an uneconomical level.

The second aspect of the present invention is directed to using the $Cr_{23}C_6$-form chromium carbide in modifying the characteristics of ordinary thermally sprayed chromium carbide coatings. Detailed will be given below.

In the present invention, the powder (3–60 μm) of $Cr_3C_2$ or a mixture thereof with $Cr_7C_3$ is used as a material for thermal spray of chromium carbide.

Alternatively, the thermally spraying material for use in the invention may be a chromium carbide-based cermet that is prepared by adding metallic elements such as Co, Ni and Cr to the above-mentioned carbides. The metallic elements may be added either singly or as alloys of two or more of such metals. The reason for using such chromium carbide-based cermets is that thermally sprayed coatings are difficult to form from the chromium carbides alone and that, even if coatings are formed, they have not only weak adhesion but also a porous structure and, hence, are incapable of serving the intended function of thermally sprayed, chromium carbide-base coatings. On the other hand, when metallic elements are added to chromium carbide, the metal components will melt completely within a heat source for thermal spray and work as a binder to form denser and more adhering coatings.

However, even if coatings are formed by thermally spraying such cermets, the coatings still contain about 0.5–5.0% of pores, which are detrimental to the purpose of improving the adhesion and wear resistance of the coatings. It is in this respect that the idea of the present invention to modify the coatings by compositing them will prove effective.

It is preferable for the purposes of the present invention to have free carbon contained in the above-described chromium carbide thermally spraying materials. Such free carbon can generally be formed by adding excess carbon when heating metal and carbon or carbon compounds (e.g., CO and CmHn) in the production of various metal carbides.

The reason why it is preferable to have free carbon contained in the thermally spraying material in the present invention is as follows. The free carbon and the metal component are allowed to contact and react in a fine particulate form on the hot thermally sprayed chromium carbide ($Cr_3C_2$, $Cr_7C_3$) coating, the metal component will immediately turn to a carbide and join firmly to the components of the thermally sprayed coating; in addition, the thermally sprayed coating is covered by the $Cr_{23}C_6$-form carbide, or the new crystal form of chromium carbide that has been generated by that reaction and, this chromium carbide also gets into the interior of the coating, particularly, in the pores in it, so as to bind with the constituent chromium carbide ($Cr_3C_2$, $Cr_7C_3$) particles in the coating to change to the $Cr_{23}C_6$ crystal form and thereby acting in such a way as to modify its properties in a markedly favorable manner.

The following examples are provided for the purpose of further illustrating the present invention but are in no way to be taken as limiting.

EXAMPLE 1

Figure 2:
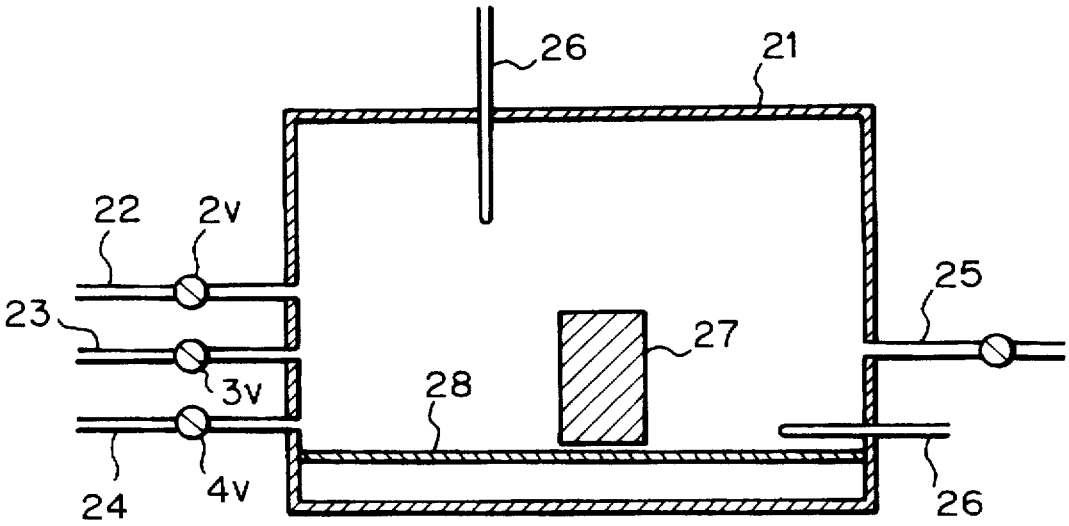
FIG. 2 is a diagrammatic view of the apparatus used in Examples 1, 2 and 4 to perform a modification treatment.

In this example, an experiment was conducted with an apparatus of the type shown in FIG. 2 in order to investigate the composition of a gas atmosphere appropriate for modifying various thermally sprayed carbide coatings to the $Cr_{23}C_6$-form carbide.

Referring to FIG. 2, numeral 21 designates a treatment vessel made of an Ni-base alloy; 22 is a pipe for supplying the vapor of a chromium halide; 23 is a pipe for supplying argon gas; 24 is a pipe for supplying hydrogen gas; and 25 is a gas exhaust pipe. The pipes 22, 23 and 24 are fitted with valves 2v, 3v, 4v, respectively, that are adjustable for the supply or emission of the gas of interest. The whole of the vessel 21 is placed within an electric furnace to permit external heating. Shown by 26 is a rod for sensing the temperature in the vessel. Shown by 27 is a workpiece that can be placed on a porous, sintered alumina plate 28.

The thermally sprayed carbide coatings used in the experiment, the gases used to treat them, and the temperature and time period for the treatment are specified below.

(1) Thermally sprayed coating under test

Test specimens (SUS 304 steel; 50 mm×100 mm×5 mm$^t$) were subjected to plasma spraying with the following carbide-based thermally spraying material ①–③ so that thermally sprayed coatings would be deposited in a thickness of 150 μm.

① 98 wt % NbC - 2 wt % C (using a carbide of a metal having greater carbon affinity than Cr)

② 69.7 wt % TiC - 20 wt % Cr - 9.7 wt % Ni - 0.3 wt % C (using a carbide of a metal having greater carbon affinity than Cr)

③ 88 wt % WC - 12 wt % Co (using a carbide of a metal having smaller carbon affinity than Cr)

(2) Treatment gases

① the vapor of chromium chloride alone (vapor pressure of $CrCl_2$=47 mmHg≈6.266×$10^3$ KPa)

② the vapor of chromium chloride mixed with an equal molar ratio of $H_2$ gas (3) Treatment temperature and time ① 1,100° C.×5 h (4) Method of evaluation The surfaces of the thermally sprayed coatings, both before and after the treatment, were analyzed by X-ray diffraction and measured for their microhardness with a micro Vickers hardness meter so as to verify the modification effect.

(5) Test results and discussion

Table 1 shows the results of the test. As one can see from the data shown in this table, the comparative samples of thermally sprayed carbide coatings under test (test Specimen Nos. 4–6) which were treated in an atmosphere solely composed of the vapor of $CrCl_2$ in the absence of hydrogen produced not only NbC, WC and $W_2C$ but also $Cr_2O_3$ and Ni in the heat source for thermal spray and analysis by X-ray diffraction revealed negligible compositional changes after the test. Even in the presence of free carbon (as in Test Specimen No. 4), there was no compositional change (the sole component was NbC) in the absence of hydrogen gas. The microhardnesses of the comparative thermally sprayed coatings were distributed within the range from 760 to 900 mHv and the values after the treatment were hardly different from initial values.

In contrast, the samples of thermally sprayed coating in compliance with the present invention (Test Specimen Nos. 1–3) which were treated by the vapor of $CrCl_2$ mixed with $H_2$ gas had the greater part of the chromium component at the coating surface changed to $Cr_{23}C_6$ and the microhardness increased to 1,000–1,290 mHv (they were hardened); obviously, they experienced changes in chemical and physical properties.

The reason for this phenomenon is that $CrCl_2$ and $H_2$ reacted according to Eq. (4) to have Cr precipitated as fine particles in the atmosphere; the precipitated Cr was deposited on the thermally sprayed coating and then reacted with either the free carbon or the carbide of W having smaller carbon affinity than Cr in the thermally sprayed coating to form the $Cr_{23}C_6$-form carbide in both cases. It should be noted here that metallic Cr detected in Test Specimen No. 2 would most probably be in an unreacted state.

TABLE 1

| No. | Composition of thermally sprayed coating | Treatment gas | Before Treatment: X-ray diffraction | Before Treatment: Microhardness | After treatment: X-ray diffraction | After treatment: Microhardness | Remarks |
|---|---|---|---|---|---|---|---|
| 1 | 98 NbC-2 C | $CrCl_2 + H_2$ | NbC | 770–900 | $Cr_{23}C_6$ NbC | 1100–1290 | Invention |
| 2 | 69.7 TiC-20 Cr-9.7 Ni-0.3 C | | $Cr_3C_2$ Ni $Cr_2O_3$ | 760–830 | $Cr_{23}C_6$ Cr | 1000–1150 | |
| 3 | 88 WC-12 Co | | WC $W_2C$ | 830–880 | $Cr_{23}C_6$ WC | 1040–1250 | |
| 4 | 98 NbC-2 C | $CrCl_2$ | NbC | 770–900 | NbC | 740–880 | Comparison |
| 5 | 72.7 $Cr_3C_2$-20 Cr-7 Ni-0.3 C | | $Cr_3C_2$ Ni $Cr_2O_3$ | 760–830 | $Cr_3C_2$ Ni $Cr_2O_3$ | 770–840 | |
| 6 | 88 WC-12 Co | | WC $W_2C$ | 830–880 | WC $W_2C$ | 820–870 | |

Notes:
(1) The figures in the column of "Composition of Thermally Sprayed Caoting" refer to percent by weight.
(2) The results of "X-ray diffraction" show only the principal diffraction peak components.
(3) "Microhardness" was measured under a load of 300 g.

EXAMPLE 2

In this example, the content of free carbon in thermally sprayed titanium carbide coatings and its transformation to $Cr_{23}C_6$ were investigated with an apparatus of the same type as used in Example 1.

(1) Thermally sprayed coatings under test (Test specimens of the same dimensions as those used in Example 1 were subjected to plasma spraying so that thermally sprayed coatings would deposit in a thickness of ca. 150 μm).

① 73 wt % TiC - 20 wt % Cr - 7 wt % Ni

② 72.99 wt % TiC - 20 wt % Cr - 7 wt % Ni - 0.01 wt % C

③ 72.5 wt % TiC - 19 wt % Cr - 8 wt % Ni - 0.5 wt % C

④ 67 wt % TiC - 21 wt % Cr - 7 wt % Ni - 5 wt % C (2) Treatment gas

① the vapor of chromium chloride mixed with an equal molar ratio of hydrogen gas (3) Treatment temperature and time ① 1,100° C.×5 h (4) Method of evaluation Same as in Example 1.

(5) Test results and discussion

Table 2 shows the results of the test. As one can see from those data, the thermally sprayed chromium carbide coating containing no free carbon (Test Specimen No. 1) was characterized by the disappearance of $TiO_2$ which was initially detected before the treatment and, in place of that, the peak for metallic Cr was clearly detectable. Stated more specifically, Cr was deposited on the surface of the thermally sprayed coating and yet no carbide could be formed in the absence of free carbon and obviously the surface maintained its initial state. Additionally, the microhardness of the coating were low and showed values of 890–1,010 mHv. Most probably, these values of measurement showed the hardness of metallic Cr.

In contrast, the thermally sprayed coating containing 0.01 wt % free carbon (Test Specimen No. 2) had a clearly detectable peak for $Cr_{23}C_6$ and its microhardness exceeded 1,000 mHv, indicating a complete modification of the coating. The thermally sprayed coating containing 5 wt % free carbon (Test Specimen No. 4) was also characterized by the peak for $Cr_{23}C_6$ and a microhardness of 1,050–1,280 mHv. It was, therefore, clear that thermally sprayed coatings could effectively be modified when their free carbon content was within the range between 0.01 and 5 wt %.

TABLE 2

| No. | Composition of thermally sprayed coating | Treatment gas | Before Treatment: X-ray diffraction | Before Treatment: Microhardness | After treatment: X-ray diffraction | After treatment: Microhardness | Remarks |
|---|---|---|---|---|---|---|---|
| 1 | 73 TiC-20 Cr-7 Ni | $CrCl_2 + H_2$ | TiC<br>Ni<br>$TiO_2$ | 760–850 | TiC<br>Cr | 890–1010 | Comparison |
| 2 | 72.99 TiC-20 Cr-7 Ni-0.01 C | | $Cr_3C_2$<br>Ni<br>$Cr_2O_3$ | 760–880 | $Cr_{23}C_6$<br>$Cr_3C_2$ | 1010–1110 | Invention |
| 3 | 72.5 TiC-19 Cr-8 Ni-0.5 C | | $Cr_3C_2$<br>Ni<br>$Cr_2O_3$ | 780–870 | $Cr_{23}C_6$<br>$Cr_3C_2$ | 1020–1210 | |
| 4 | 67 TiC-21 Cr-7 Ni-5 C | | $Cr_3C_2$<br>Ni<br>$Cr_2O_3$<br>C | 720–820 | $Cr_{23}C_6$ | 1050–1280 | |

Notes:
(1) The figures in the column of "Composition of Thermally Sprayed Coating" refer to percent by weight.
(2) The results of "X-ray diffraction" show only the principal diffraction peak components.
(3) "Microhardness" was measured with a micro Vickers hardness meter under a load of 300 g.

EXAMPLE 3

In this example, an investigation was made as to how thermally sprayed titanium carbide coatings were influenced by the presence of other carbides or by the inclusion of carbides of metals having greater carbon affinity than Cr. The size of the test specimens used and the thickness of the thermally sprayed coatings formed on those test specimens were each the same as in Example 1.

(1) Thermally sprayed coatings under test

① 69.5 wt % TiC - 20 wt % Cr - 10 wt % Ni - 0.5 wt % C

② 60 wt % TiC - 10 wt % $Fe_3C$ - 20 wt % Cr - 10 wt % Ni

③ 91 wt % TiC - 9 wt % SiC

④ 83 wt % TiC - 8 wt % BC - 9 wt % Co - 10 wt % Cr

⑤ 70 wt % NbC - 10 wt % $Fe_3C$ - 15 wt % Cr - 5 wt % Ni

⑥ 92 wt % WC - 8 wt % Co

⑦ 30 wt % TiC - 20 wt % MoC - 10 wt % TaC - 20 wt % ZrC - 5 wt % HfC - 13 wt % Co - 2 wt % C

⑧ 90 wt % NbC - 8 wt % Cr - 2 wt % Ni (without free C)

Figure 3:
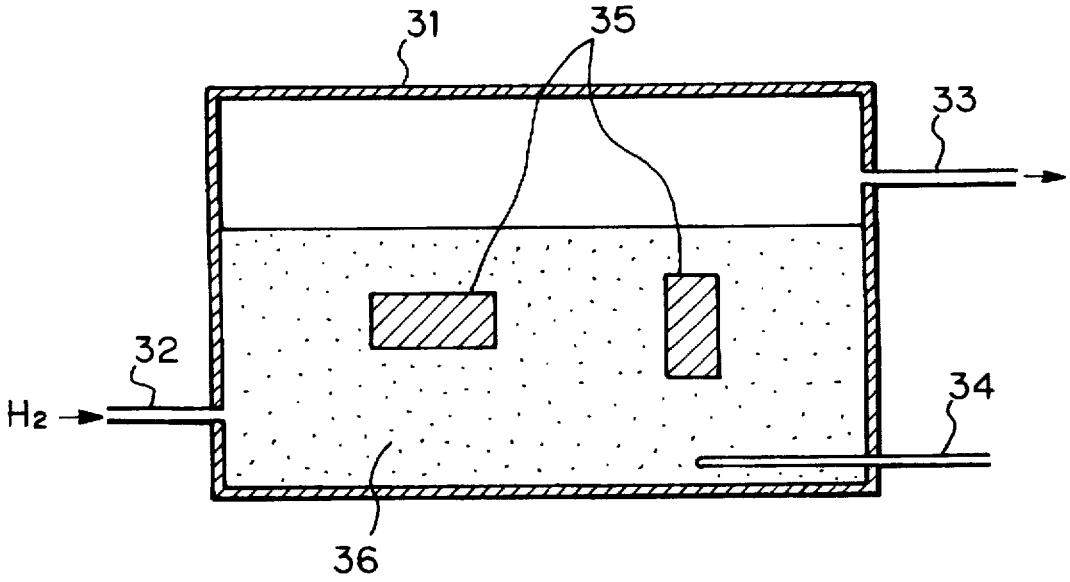
FIG. 3 is a diagrammatic view of the apparatus used in Examples 3, 5, 6, and 7 to perform a modification treatment.

Among the thermally sprayed coatings under test set forth above, ①–⑦ were samples in accordance with the invention and ⑧ was a comparative sample which was a thermally sprayed coating containing a carbide of a metal having greater carbon affinity than Cr but which contained no free carbon. In Example 3, treatment was conducted at 1,000° C. for 6 h using an apparatus of the type shown in FIG. 3 with hydrogen gas being allowed to flow at a rate of 100 ml per minute. After the treatment, the thermally sprayed coatings were subjected to analysis by X-ray diffraction and measurement for microhardness. Referring to FIG. 3, numeral 31 designates a treatment vessel made of an Ni-base alloy; 32 is a pipe for supplying hydrogen gas; 33 is a gas exhaust pipe; 34 is a rod for sensing the temperature in the treatment vessel; 35 is a workpiece (thermally sprayed coating as test specimen); and 36 is a penetrant consisting of 70 wt % Cr powder, 29 wt % alumina and 1.0 wt % ammonium chloride.

Table 3 summarizes the results of investigation. The comparative sample (No. 8) was a thermally sprayed coating containing no free carbon but containing a carbide of a metal having greater carbon affinity than Cr. Even when this coating was so treated as to form a Cr deposit, there was no detectable creation of the $Cr_{23}C_6$-form chromium carbide and the increase in hardness was only negligible.

Figure 1B:
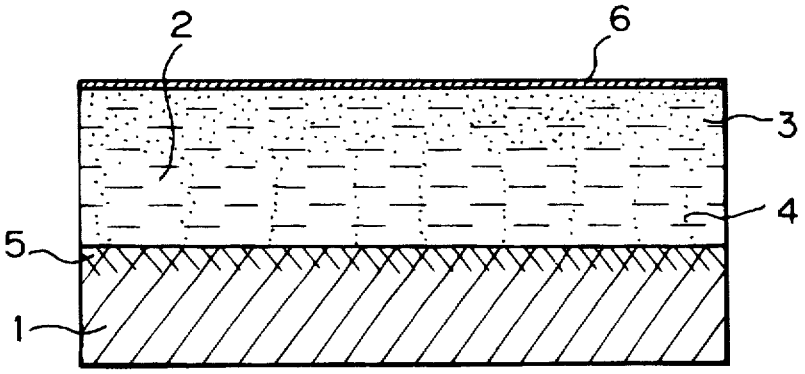
FIG. 1B is a cross section of the same coating after the treatment.

FIG. 1 shows in two cross sections a thermally sprayed, carbide-base coating that was thus modified in accordance with the invention. FIG. 1A shows a metallic substrate 1 that was made of steel or a superhard alloy and which was thermally sprayed with various carbide-based cermet coatings 2. FIG. 1B shows the cross-sectional structure of the coating shown in FIG. 1A after it was contacted by the vapor of hot, $H_2$ gas containing chromium halide. The fine particles of metallic chromium 3 that were precipitated in the chromium halide gas atmosphere diffused into the thermally sprayed coating 2 through pores 4 and reacted with the substrate 1 to form an alloy layer 5 that served as a metallurgical binding layer. The fine particles of metallic Cr also deposited on the surface of the thermally sprayed coating 2 and reacted with either the chromium carbide component or the free carbon in it to create a $Cr_{23}C_6$-form carbide layer 6.

In contrast with the comparative sample, all the coatings of the invention (Nos. 1–7) were characterized by the creation of the $Cr_{23}C_6$-form chromium carbide, as well as noticeable increases in hardness. The coating containing $Fe_3C$ in addition to NbC (No. 5), the coatings containing carbides of metals having smaller carbon affinity than Cr (like WC-Co in sample No. 6 or TiC-$Fe_3C$-Cr-Ni in sample No. 2), and the coatings that contained carbides of metals having greater carbon affinity than Cr but which also contained free carbon (Nos. 1 and 7) were characterized by obvious creation of the $Cr_{23}C_6$-form chromium carbide and substantial increases in hardness. It is, therefore, clear that the concept of the invention is effective not only for coatings containing only carbides of metals having smaller carbon affinity than Cr but also for coatings containing carbide of two metal species, one having greater carbon affinity than Cr and the other having smaller carbon affinity.

(2) Treatment gases

① the vapor of chromium chloride alone (vapor pressure of $CrCl_2$=47 mmHg≃6.266×$10^3$ kPa)

② the vapor of chromium chloride mixed with an equal volume of $H_2$ gas (3) Treatment temperature and time ① 1,100° C.×5 h (4) Method of evaluation The surfaces of the thermally sprayed coatings, both before and after the treatment, were analyzed by X-ray diffraction and measured for their microhardness with a micro Vickers hardness meter so as to verify the modification effect.

(5) Test results and discussion

Table 4 shows the results of the test. As one can see from the data shown in this table, the thermally sprayed, chromium carbide coatings under test were such that prior to the heat treatment, the principal components of the thermally spraying materials in a powder form including the $Cr_2O_3$ generated by oxidation in the heat source for thermal spray at elevated temperature substantially remained in their initial state. However, in the coating samples that were formed using 72.7 wt % $Cr_3C_2$ - 20 wt % Cr - 7 wt % Ni - 0.3 wt % C and 69.8 wt % $Cr_3C_2$ - 30 wt % Cr - 0.2 wt % C (as in Test Specimens Nos. 1, 2, 4 and 5), there was observed $Cr_2O_3$ which would be the product of partial change of $Cr_3C_2$ in the heat source at elevated temperature. When the thermally sprayed, chromium carbide coatings were treated in an atmosphere solely composed of the vapor of $CrCl_2$ in the absence of hydrogen (as in Test Specimens Nos. 4, 5 and 6), the components identified by X-ray diffraction before treatment were found to remain in their initial state. The micro-hardnesses of those samples were distributed within the range from 760 to 890 mHv but the values after the treatment did not have any recognizable differences from the initial values. It is, therefore, clear that when exposed to an atmosphere that was solely composed of the vapor of $CrCl_2$ in the absence of hydrogen, there was no precipitation of Cr and, hence, the thermally sprayed, chromium carbide coatings experienced little change (modification).

TABLE 3

| No. | Composition of thermally sprayed coating | Treatment gas | Before Treatment: X-ray diffraction | Before Treatment: Micro-hardness | After treatment: X-ray diffraction | After treatment: Micro-hardness | Remarks |
|---|---|---|---|---|---|---|---|
| 1 | 69.5 TiC-20 Cr-10 Ni-0.5 C | $CrCl_2 + H_2$ | TiC<br>$TiO_2$ | 760–850 | $Cr_{23}C_6$ | 1100–1310 | Invention |
| 2 | 60 TiC-10 $Fe_2C$-20 Cr-10 Ni | | TiC<br>$Fe_3C$ | 770–900 | $Cr_{23}C_6$ | 1200–1320 | |
| 3 | 91 TiC-9 SiC | | TiC<br>SiC | 720–820 | $Cr_{23}C_6$<br>Cr | 1100–1499 | |
| 4 | 83 TiC-8 BC-9 Co-10 Ni | | TiC<br>BC | 770–880 | $Cr_{23}C_6$ | 1010–1280 | |
| 5 | 70 NbC-10 $Fe_3C$-15 Cr-5 Ni | | NbC<br>$Fe_3O_4$ | 800–910 | $Cr_{23}C_6$<br>Cr | 1100–1280 | |
| 6 | 92 WC-8 Co | | WC<br>$W_2C$ | 980–1010 | $Cr_{23}C_6$<br>Cr | 1080–1310 | |
| 7 | 30 $TiC_1$-20 MoC-10 TaC<br>20 ZrC-5 HfC-13 Co-2 C | $CrCl_2 + H_2$ | TiC, MoC<br>ZrC, HfC<br>$TiO_2$, $CoO_2$ | 800–950 | $Cr_{23}C_6$<br>TiC | 1200–1280 | Invention |
| 8 | 90 NbC-8 Cr-2 Ni | | NbC<br>NbO | 780–920 | NbC<br>Cr | 780–910 | Comparison |

Notes:

(1) The figures in the column of "Composition of Thermally Sprayed Coating" refer to percent by weight.

(2) The results of "X-ray diffraction" show only the principal diffraction peak components.

(3) "Microhardness" was measured with a micro Vickers hardness meter under a load of 300 g.

(4) The "treatment gas" was a reactive gas $CrCl_2$ that was evolved by heating a penetrant (70 wt % Cr powder, 29 wt % alumina and 1 wt % ammonium chloride) under an $H_2$ gas stream).

EXAMPLE 4

In this example, an experiment was conducted with an apparatus of the same type as used in Example 1. In order to investigate the composition of a gas atmosphere appropriate for modifying a portion (surface layer) of $Cr_3C_2$-base, thermally sprayed chromium carbide coatings to the $Cr_{23}C_6$-form carbide.

The test pieces of thermally sprayed chromium carbide coatings used in the experiment, the gases used to treat them, and the temperature and time period for the treatment are specified below.

(1) Thermally sprayed coatings under test

Test specimens (SUS 305 steel; 50 mm×100 mm×5 $mm^t$) were subjected to plasma spraying with the following chromium carbide thermally spraying materials ①–③ so that thermally sprayed coatings would be deposited in a thickness of 150 μm.

① 72.7 wt % $Cr_3C_2$ - 20 wt % Cr - 7 wt % Ni - 0.3 wt % C

② 69.8 wt % $Cr_3C_2$ - 30 wt % Cr - 0.2 wt % C

③ 92.8 wt % $Cr_3C_2$ - 7 wt % $Cr_7C_3$ - 0.2 wt % C

In contrast, when the vapor of $CrCl_2$ contained hydrogen gas (as in Test Specimens Nos. 1, 2 and 3), almost all part of the surface of the thermally sprayed coatings turned to $Cr_{23}C_6$ and the microhardness increased to 1,020–1,280 mHv; obviously, the thermally sprayed coatings experienced changes in crystallographic and mechanical properties.

The reason for this phenomenon is as follows: in the vapor of chromium chloride containing hydrogen gas, active metallic Cr was precipitated as fine particles in the vapor phase in accordance with chemical reaction of formula (7) and the precipitated, active metallic Cr deposited on the thermally sprayed coating and then reacted with the free carbon in the thermally sprayed coating to generate the $Cr_{23}C_6$-form chromium carbide:

$$CrCl_2+H_2 \rightarrow Cr+2HCl \quad (7)$$

A: Placed in a gaseous atmosphere consisting of the vapor of chromium chloride mixed with an equal volume of hydrogen gas (see FIG. 2); 1,100° C.×5 h B: Buried in a penetrant consisting of a chromium powder (70 wt %), an alumina powder (20 wt %) and ammonium chloride (10 wt %) (see FIG. 3); 1,100° C.×10 hr (3) Method of evaluation Same as in Example 1.

Table 5 shows the results of the test. As one can see from those data, the thermally sprayed, chromium carbide coating containing no free carbon (Test Specimen No. 1) was characterized by the disappearance of $Cr_2O_3$ which was initially detected before the treatment (as generated in the heat source for thermally spray). On the other hand, $Cr_3C_2$ as well as small amounts of Cr and $Cr_{23}C_6$ were found to have been generated, indicating that $Cr_3C_2$ had changed to

TABLE 4

| No. | Composition of thermally sprayed coating | Treatment gas | Before Treatment: X-ray diffraction | Before Treatment: Microhardness | After treatment: X-ray diffraction | After treatment: Microhardness | Remarks |
|---|---|---|---|---|---|---|---|
| 1 | 72.7 $Cr_3C_2$-20 Cr-7 Ni-0.3 C | $CrCl_2 + H_2$ | $Cr_3C_2$<br>Ni<br>$Cr_2O_3$ | 760–830 | $Cr_{23}C_6$ | 1000–1150 | Invention |
| 2 | 69.8 $Cr_3C_2$-30 Cr-0.2 C | | $Cr_3C_2$<br>$Cr_2O_3$ | 760–880 | $Cr_{23}C_6$ | 1020–1280 | |
| 3 | 92.8 $Cr_3C_2$-7 $Cr_7C_3$-0.2 C | | $Cr_3C_2$<br>$Cr_7C_3$ | 790–890 | $Cr_{23}C_6$ | 1050–1120 | |
| 4 | 72.7 $Cr_3C_{2\text{-}20\ Cr\text{-}7\ Ni\text{-}0.3\ C}$ | $CrCl_2$ | $Cr_3C_2$<br>Ni<br>$Cr_2O_3$ | 760–830 | $Cr_3C_2$<br>Ni<br>$Cr_2O_3$ | 760–820 | Comparison |
| 5 | 69.8 $Cr_3C_2$-30 Cr-0.2 C | | $Cr_3C_2$<br>$Cr_2O_3$ | 760–880 | $Cr_3C_2$<br>$Cr_2O_3$ | 750–870 | |
| 6 | 92.8 $Cr_3C_2$7 $Cr_7C_3$-0.2 C | | $Cr_3C_2$<br>$Cr_7C_3$ | 790–890 | $Cr_3C_2$<br>$Cr_7C_3$ | 770–890 | |

EXAMPLE 5

In this example, the content of free carbon in thermally sprayed chromium carbide coatings and its transformation to $Cr_{23}C_6$ were investigated with an apparatus of the type shown in FIG. 3. Referring to FIG. 3, numeral 31 designates a treatment vessel made of an Ni-base alloy; 32 is a pipe for supplying hydrogen gas; 33 is a gas exhaust pipe; 34 is a rod for sensing the temperature in the treatment vessel; 35 is a workpiece (thermally sprayed coating as test specimen); and 36 is a penetrant consisting of 70 wt % Cr powder, 29 wt % alumina and 1.0 wt % ammonium chloride.

(1) Thermally sprayed coatings under test (test specimens of the same dimensions as those used in Example 1 were subjected to plasma spraying so that thermally sprayed coatings would deposit in a thickness of ca. 150 μm).

① 73 wt % $Cr_3C_2$ - 20 wt % Cr - 7 wt % Ni

② 72.99 wt % $Cr_3C_2$ - 20 wt % Cr - 7 wt % Ni - 0.01 wt % C

③ 72.5 wt % $Cr_3C_2$ - 19 wt % Cr - 8 wt % Ni - 0.5 wt % C

④ 67 wt % $Cr_3C_2$ - 21 wt % Cr - 7 wt % Ni - 5 wt % C (2) Method of modification treatment $Cr_{23}C_6$ even in the absence of free carbon (≦0.01 wt %). Although the increase in the hardness of the thermally sprayed coating as the result of the treatment was comparatively small due to the small generation of $Cr_{23}C_6$, a reasonable improvement in the density and adhesion of the thermally sprayed coating may well be expected.

In contrast, the thermally sprayed coating containing 0.01 wt % free carbon (Test Specimen No. 2) had a clearly detectable peak for $Cr_{23}C_6$ and its microhardness exceeded 1,000 mHv, indicating a complete modification of the coating. Additionally, the thermally sprayed coating containing 5 wt % free carbon (Test Specimen No. 4) was also characterized by the peak for $Cr_{23}C_6$ and a microhardness of 1,050–1,280 mHv. It was therefore clear that thermally sprayed coatings could effectively be modified when their free carbon content was within the range between 0.01 and 5 wt %.

Initially, the thermally sprayed coating that did not contain free carbon had a detectable amount of $Cr_2O_3$(as generated by partial oxidation of $Cr_3O_2$ in the heat source for thermally spray) but it disappeared after the treatment probably due to reduction to Cr with hydrogen.

TABLE 5

| | Composition of | Modifications | Before Treatment X-ray | | After treatment X-ray | Micro- | Remarks |
|---|---|---|---|---|---|---|---|
| 1 | 73 $Cr_3C_2$-20 Cr-7 Ni | A | $Cr_3C_2$ Ni $Cr_2O_3$ | 760–850 | $Cr_3C_2$ Cr $Cr_{23}C_6$ | 890–1010 | Invention |
| 2 | 72.99 $Cr_3C_2$-20 Cr-7 Ni-0.01 C | B | $Cr_3C_2$ Ni $Cr_2O_3$ | 760–880 | $Cr_{23}C_6$ $Cr_3C_2$ | 1010–1110 | |
| 3 | 72.5 $Cr_3C_2$-19 Cr-8 Ni-0.5 C | A | $Cr_3C_2$ Ni $Cr_2O_3$ | 780–870 | $Cr_{23}C_6$ $Cr_3C_2$ | 1020–1210 | |
| 4 | 67 $Cr_3C_2$-21 Cr-7 Ni-5 C | B | $Cr_3C_2$ Ni $Cr_2O_3$ C | 720–820 | $Cr_{23}C_6$ | 1050–1280 | |

Notes:
(1) The figures in the column of "Composition of Thermally Sprayed Coating" refer to percent by weight.
(2) The results of "X-ray diffraction" show only the principal diffraction peak components.
(3) "Microhardness" was measured with a micro Vickers hardness meter under a load of 300 g.
(4) Modification treatment was performed by either A: exposure to an atmosphere of $CrCl_2 + H_2$ gas at 1,100° C. for 5 h, or B: burial in a penetrant consisting of Cr powder (70.0 wt %) + $Al_2O_3$ powder (29.0 wt %) + $NH_4Cl$ (1.0 wt %) at 1,100° C. for 10 h.

EXAMPLE 6

(Improvement In Corrosion Resistance by Eliminating Pores In Thermally Sprayed Coatings)

As is well known coatings formed by thermal spray in atmospheric air will always contain pores, which can be a cause of reduced corrosion resistance. Considering the process for producing the modified thermally sprayed coatings that is used in the present invention, as well as the mechanism behind that process, the thermally sprayed coatings may be so modified that the existing pores are eliminated. In order to verify this possibility, an experiment was conducted to see whether the process under consideration would have a pore closing capability.

In Example 6, test specimens made of carbon steel (SUS 400) measuring 50 mm×100 mm×5 $mm^t$ were coated on one side with carbide-based cermet coatings in a thickness of 150 μm by either plasma or high-speed flame thermally spray. Thereafter, the specimens were set in an apparatus of the type shown in FIG. 3 and subjected to a heat treatment at 930° C. for 10 hours so as to modify the thermally sprayed coatings. The thus modified coatings were subjected to a salt spray test as specified in JIS Z 2371 (1988). The effectiveness of the modification treatment in closing pores was evaluated on the basis of the severity of red rust formation from residual pores in the coatings.

(1) Thermally sprayed coatings under test

① 73 wt % $Cr_3C_2$ - 20 wt % Cr - 7 wt % Ni

② 62 wt % $Cr_3C_2$ - 11 wt % $Cr_7C_3$ - 18 wt % Cr - 9 wt % Ni

Prior to the salt spray test, a cross section of each of the unmodified coatings was examined with both an optical and a scanning electron microscope and the porosity was calculated from the percentage of the visual field occupied by pores.

Table 6 shows the results of the examination of the exterior appearance of the coatings that was conducted both 24 hours and 96 hours after the start of the salt spray test. As is clear from the data in Table 6, the comparative coatings (Run Nos. 7 and 8) suffered from the local development of red rust in spots as early as 24 hours after the salt spray test and 96 hours later, 8–15% of the coating area was covered with red rust. Thus, salt water penetrated the coatings through pores and corroded the base metal (soft steel) to yield the corrosion product, which formed red rust that erupted on the surface of the coatings. The severity of red rust formation was greater in Run No. 7 which was the plasma sprayed coating having the higher porosity.

In contrast, the thermally sprayed coatings that were modified in accordance with the invention (Run Nos. 1–6) were entirely free from the evidence of red rust formation and maintained integrity even after the lapse of 96 hours. This would be because the fine particles of metallic Cr which were precipitated in the atmosphere by performing heat treatment in a chromium halide gas containing hydrogen gas filled the pores in the coatings, thereby preventing salt water from getting into the coating interior.

As the above results show, the thermally sprayed coatings that were modified in accordance with the invention were freed of internal pores by means of filling with the particles of metallic Cr, so they are expected to be suitable for use at much higher temperatures than thermally sprayed coatings that are treated with conventional organic pore closing agents.

TABLE 6

| No. | Composition of thermally sprayed coating | Method of thermal spray | Coating porosity, % | Heat treatment in $CrCl_2 + H_2$ | After salt spray test 24 h | After salt spray test 96 h | Remarks |
|---|---|---|---|---|---|---|---|
| 1 | 73 $Cr_3C_2$-20 Cr-7 Ni | plasma | 3.7–5.2 | Yes | No change | No change | Invention |
| 2 | | high-speed flame | 0.5–1.5 | " | " | " | |
| 3 | 62 $Cr_3C_2$-11 $Cr_7C_3$-18 Cr-9 Ni | plasma | 3.5–5.0 | " | " | " | |
| 4 | | high-speed flame | 0.5–1.5 | " | " | " | |
| 5 | 73 $Cr_3C_2$-20 Cr-7 Ni | plasma | 3.7–5.2 | " | " | " | |
| 6 | | high-speed flame | 0.5–1.5 | " | " | " | |
| 7 | 62 $Cr_3C_2$-11 $Cr_7C_3$-18 Cr-9 Ni | plasma | 3.5–5.0 | No | Red rust formed | Red rust coverage 15% | Comparison |
| 8 | | high-speed flame | 0.5–1.5 | " | Red rust formed | Red rust coverage 8% | |

Note:
(1) The figures in the column of "Composition of Thermally Sprayed Coating" refer to percent by weight.

EXAMPLE 7

(Enhancement of Thermal Shock Resistance by Improvement in the Adhesion of Thermally Sprayed Coatings)

Test specimens made of steel (SUS 304) measuring 50 mm×100 mm×5 mm$^t$ were coated on one side with chromium carbide-based cermet coatings in a thickness of 150 μm by plasma spray. Thereafter, the specimens were set in an apparatus of the type shown in FIG. 3 and subjected to a heat treatment at 930° C. for 10 hours so as to produce members having the thermally sprayed coatings modified in accordance with the invention.

The members were then subjected to repeated thermal shock cycles consisting of holding in an electric furnace at 1,000° C. for 15 minutes and subsequent immersion into water at 25° C. The thus treated members were examined for the peeling of the thermally sprayed coatings. For comparison, thermally sprayed, carbide-based cermet coatings that were not given any heat treatment were subjected to a thermal shock test under the same conditions as described above.

(1) Thermally sprayed coatings under test

① 73 wt % $Cr_3C_2$ - 20 wt % Cr - 7 wt % Ni

② 62 wt % $Cr_3C_2$ - 11 wt % $Cr_7C_3$ - 18 wt % Cr - 9 wt % Ni

Table 7 shows the results of the thermal shock tests. After 12–14 thermal shock cycles, the comparative samples which were not given any heat treatment (Run Nos. 3 and 4) suffered from partial separation of thermally sprayed coatings and after 15 thermal shock cycles, 40–50% of the coatings completely came off. In contrast, the thermally sprayed coatings that were modified in accordance with the invention (Run Nos. 1 and 2) did not peel even after 20 thermal shock cycles and they maintained integrity except that the surface color turned green; therefore, the samples of the invention were found to have strong resistance to thermal shocks.

TABLE 7

| No. | Composition of thermally sprayed coating | Heat treatment in $CrCl_2 + H_2$ | Results of thermal shock test | Remarks |
|---|---|---|---|---|
| 1 | 73 $Cr_3C_2$-20 Cr-7 Ni | Yes | Turned green black but no peeling occurred even after 20 cycles | Invention |
| 2 | 62 $Cr_3C_2$-11 $Cr_7C_3$-18 Cr-9 Ni | Yes | Turned green black but no peeling occurred even after 20 cycles | |
| 3 | 73 $Cr_3C_2$-20 Cr-7 Ni | No | Local peeling occurred after 12 cycles and 40% of the coating separated after 15 cycles | Comparison |
| 4 | 62 $Cr_3C_2$-11 $Cr_7C_3$-18 Cr-9 Ni | No | Local peeling occurred after 13 cycles and 50% of the coating separated after 15 cycles | |

Note:
(1) The figures in the column of "Composition of Thermally Sprayed Coating" refer to percent by weight.

EXAMPLE 8

In this example, the molar ratio of a chromium chloride gas to $H_2$ gas was varied and the resulting changes in the thickness of the $Cr_{23}C_6$-form chromium carbide modified layer were investigated.

(1) Thermally sprayed coatings under test were prepared by coating test specimens of the same size as used in Example 1 with the following composition to a thickness of 150 μm by plasma spraying: 72.7 wt % $Cr_3C_2$ - 20 wt % Cr - 7 wt % Ni - 0.3 wt % C.

(2) Modifying conditions

Using an apparatus of the type shown in FIG. 2, a modification treatment was performed for 16 h under two temperature conditions, 500° C. and 1,100° C., with the molar ratio of $CrCl_2$ to $H_2$ gas being varied from 5:95 to 95:5. For treatment at 1,200° C., only one condition (16 h at 50:50) was employed.

(3) Method of evaluation

The formation of the $Cr_{23}C_6$ phase as a result of modification by the fine particles of metallic chromium that diffused into the interior of each thermally sprayed coating from the surface was verified by X-ray diffraction and its thickness was measured.

(4) Results of evaluation

Figure 4:
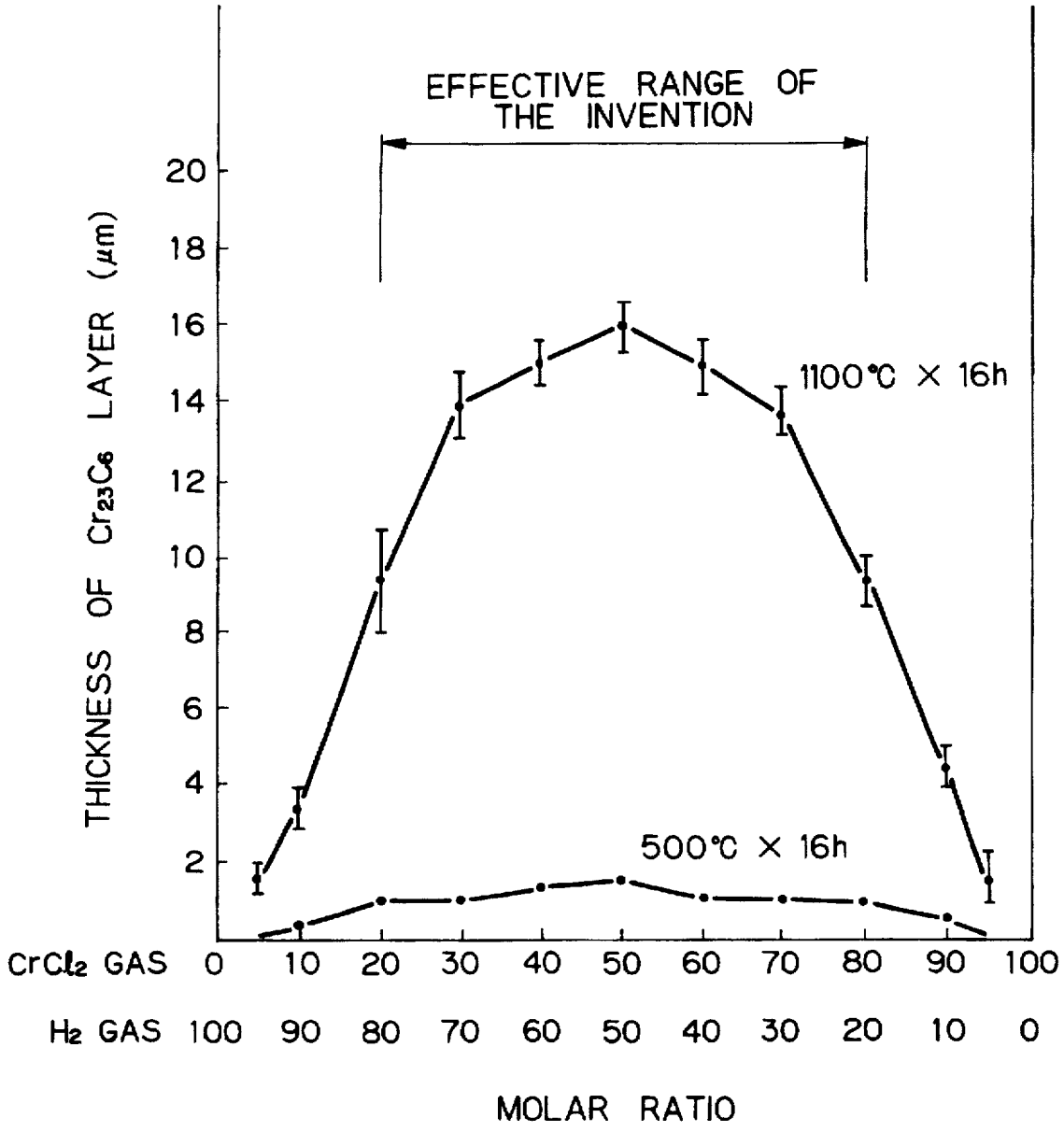
FIG. 4 is a graph showing the relationship between the thickness of $Cr_{23}C_6$ layer VS the molar ratio of $CrCl_2$ to $H_2$ gas, for 16 h under two temperature conditions, 500° C. and 1,100° C.

FIG. 4 shows the results of Example 8. Obviously, the treatment at 1,100° C. for 16 h produced comparatively thick modified layers whereas the treatment at 500° C. for 16 h produced very thin (1–2 μm) layers. Upon closer examination, one can see the following: the thickness of modified layers was the greatest at a $CrCl_2/H_2$ molar ratio of 50/50 (1/1) irrespective of the temperature employed, and their thickness decreased when the molar ratio of $CrCl_2$ to $H_2$ deviated from 1:1. This is considered because the change in the $CrCl_2$ to $H_2$ molar ratio caused a corresponding change in the amount of Cr precipitation in a vapor phase.

Since the modified layer to be formed in the invention is required to have preferably a minimum thickness of about 1 μm, one can see from FIG. 4 that in order to insure this minimum thickness at 500° C., the $CrCl_2/H_2$ molar ratio may be within the range from about 80/20 (4/1) to about 20/80 (1/4).

When modification was performed at 1,200° C. for 16 h at a $CrCl_2/H_2$ molar ratio of 50/50, the modified layer in the carbide thermally sprayed coating was about 30 μm at maximum.

According to the first aspect of the invention, thermally sprayed coatings made from carbides of metals having greater carbon affinity than Cr in the presence of free carbon, or thermally sprayed coatings made from carbides of metals having smaller carbon affinity than Cr are heat treated in a chromium halide containing atmosphere which also contains hydrogen gas, whereby activated metallic Cr can be precipitated in a fine particulate form. In the invention, these fine particles of activated metallic Cr are allowed to act on the thermally sprayed coatings, whereupon a $Cr_{23}C_6$-form carbide is created both on the coating surface and within pores in the coating to produce a composite structure in the thermally sprayed carbide coatings to thereby modify them. In addition, the thus modified thermally sprayed coatings contribute greatly to an improvement in corrosion resistance due to the elimination of pores, as well as to an improvement in wear and erosion resistance due to the increased microhardness of the coatings that was achieved by the creation of $Cr_{23}C_6$.

According to the second aspect of the invention, thermally sprayed coatings containing ① $Cr_3C_2$, $Cr_7C_3$-form chromium carbide or ② carbides of metals having smaller carbon affinity than Cr are heat treated in a chromium halide generating atmosphere which also contains hydrogen gas, whereby activated metallic Cr can be precipitated in a fine particulate form. In the invention, these fine particles of activated metallic Cr are allowed to act at least on the surface of the thermally sprayed coatings, whereupon a $Cr_{23}C_6$-form carbide is created both on the coating surface and within pores in the coating to produce a composite structure in the thermally sprayed chromium carbide coatings, thereby modifying their surface layer. In addition, the thus modified thermally sprayed coatings contribute greatly to an improvement in corrosion resistance due to the elimination of pores, as well as to an improvement in wear and erosion resistance due to the increased microhardness of the coatings that are achieved by the creation of $Cr_{23}C_6$.

What is claimed is:

1. A composite coating comprising a thermally sprayed coating that is formed on a surface of a substrate and which coating is made of at least one carbide selected from among NbC, TaC, HfC, VC, ZrC, MnC, FeC, NiC, CoC, SiC, WC, MoC, TiC and BC or carbide-containing cermet made of said carbide and at least one metal selected from among Ni, Cr and Co, and a modified layer having a $Cr_{23}C_6$-form carbide produced both on the surface of said thermally sprayed coating and in its interior through the reaction of metallic chromium precipitated in a fine particulate form in a heated atmosphere consisting of hydrogen and a chromium halide with the carbon and chromium components in said thermally sprayed coating.

2. A member having a thermally sprayed chromium carbide coating comprising a substrate having a thermally sprayed chromium carbide coating formed on its surface, said thermally sprayed chromium carbide coating being such that at least the surface layer thus modified by deposition and impregnation of $Cr_{23}C_6$-form chromium carbide.

3. A member according to claim 2 wherein the carbide that makes up said thermally sprayed chromium carbide coating formed on the surface of the substrate contains $Cr_{23}C_6$ either alone or in admixture with $Cr_7C_3$.

4. A member according to claim 2 or 3 wherein said thermally sprayed carbide-containing coating contains $Cr_3C_2$, $Cr_7C_3$ carbide that does not contain free carbon or contains either 0.01–5 wt % of free carbon or 0.1–100 wt % of a carbide of a metal having smaller carbon affinity than chromium or both.

5. A member according to claim 2 wherein said layer modified with a thickness of about 1–30 μm of $Cr_{23}C_6$-form chromium carbide is formed by heat treating the sprayed chromium carbide coating at 500°–1,200° C. in a chromium halide containing atmosphere which also contains hydrogen gas, thereby precipitating chemically active, fine-particulate metallic chromium, which is deposited on and impregnated into the surface of the thermally sprayed coating.

6. A member according to claim 2 wherein the thermally sprayed chromium carbide coating is formed on the surface of the substrate by thermal spraying a carbide-based cermet comprising $Cr_3C_2$ or a mixture thereof with $Cr_7C_3$ and at least one metal selected from among Ni, Cr and Co.

7. A method of forming a carbide-base composite coating which comprises the steps of forming a thermally sprayed, carbide-base coating on a surface of a substrate, then heat treating said thermally sprayed coating in a chromium halide containing atmosphere which also contains hydrogen gas, thereby forming a composite coating comprising both a thermally sprayed, carbide-base coating and a modified layer that has a $Cr_{23}C_6$-form carbide coated on a surface of said thermally sprayed, carbide-base coating and diffused into its interior.

8. A method of forming a carbide-base composite coating which comprises the steps of forming a thermally sprayed, carbide-base coating on a surface of a substrate, then heat treating said thermally sprayed coating in a chromium halide containing atmosphere which also contains hydrogen gas, thereby precipitating the fine particles of chemically active metallic chromium on said thermally sprayed coating while, at the same time, allowing said fine particles of metallic chromium to be coated on a surface of said thermally sprayed coating and diffused into its interior so as to produce a $Cr_{23}C_6$-form chromium carbide through reaction with the components of said coating, thereby forming a composite coating having the thermally sprayed, carbide-base coating modified both on the surface and in the interior.

9. A method according to claim 7 or 8 wherein said thermally sprayed, carbide-base coating contains either 0.01–5 wt % of free carbon or 0.1–100 wt % of a carbide of a metal having smaller carbon affinity than chromium or both.

10. A method according to claim 7 or 8 wherein the heat treatment in a chromium halide containing atmosphere which also contains hydrogen gas is performed as the substrate carrying the thermally sprayed, carbide-base coating is either placed in the gas of at least one chromium halide selected from among chromium chloride, chromium bromide, chromium fluoride and chromium iodide or buried in a powder capable of evolving said gas, with the atmosphere being heated at 500°–1,200° C. for performing reduction reaction with the hydrogen gas contained, the mixing molar ratio of the chromium halide gas and hydrogen gas is preferably adjusted within a range from about 4:1 to about 1:4, thereby precipitating the fine particles of chemically active metallic chromium and forming preferably a thickness of about 1–30 μm of $Cr_{23}C_6$ layer.

* * * * *